US005933090A

United States Patent [19]

Christenson

[11] Patent Number: 5,933,090

[45] Date of Patent: Aug. 3, 1999

[54] METHOD AND APPARATUS FOR FIELD PROGRAMMING A REMOTE CONTROL SYSTEM

[75] Inventor: Keith A. Christenson, Canton, Mich.

[73] Assignee: UT Automotive Dearborn, Inc., Dearborn, Mich.

[21] Appl. No.: 08/702,126

[22] Filed: Aug. 23, 1996

[51] Int. Cl.[6] ..... G08C 17/02

[52] U.S. Cl. ..... 340/825.69; 340/825.31; 340/825.34; 307/10.2; 341/176; 70/256; 367/197

[58] Field of Search ..... 340/825.69, 825.31, 340/825.72, 825.34; 307/10.2; 361/171, 172; 341/176, 9; 70/256, 257; 367/197, 199; 377/33

[56] References Cited

U.S. PATENT DOCUMENTS 4,881,148 11/1989 Lambropoulos et al. ..... 361/172
5,109,221 4/1992 Lambropoulos et al. ..... 340/825.69
5,146,215 9/1992 Drori ..... 340/825.32
5,442,341 8/1995 Lambropoulos ..... 340/825.31
5,650,774 7/1997 Drori ..... 340/825.31 X

*Primary Examiner*—Michael Horabik
*Assistant Examiner*—William H. Wilson, Jr.
*Attorney, Agent, or Firm*—Howard & Howard

[57] ABSTRACT

A remote control system comprises a transmitter for transmitting a first data signal having a command and an identification code. Further, the remote control system comprises a receiver for receiving the first data signal having an operational mode for initiating the received command if the first received identification code matches a stored authentic and valid identification code, and a programming mode for storing received valid identification codes. If the receiver is in a first session of the programming mode, the processor tests the validity of the first received identification code, unauthenticates the stored authentic and valid identification codes should the first received identification code be valid, and writes the first received, tested and validated identification code into a first location in memory as authentic and valid.

22 Claims, 3 Drawing Sheets

METHOD AND APPARATUS FOR FIELD PROGRAMMING A REMOTE CONTROL SYSTEM

FIELD OF THE INVENTION

The present invention relates to remote control systems generally and more specifically to vehicle remote actuation systems for sending commands to a receiver to actuate specific features associated with the system.

BACKGROUND OF THE INVENTION

In the automotive industry, remote keyless entry ("RKE") systems have become standard equipment for new vehicles. Comprising a receiver within the car and a number of fob transmitters for transmitting to the receiver, remote keyless entry systems. enable users to control several vehicle functions remotely, such as the door locks and trunk, for example.

In providing remote control to vehicle functions, a problem arises as to restricting remote access to the automobile's owners and authorized users. To prevent unauthorized access, an identification system is incorporated with a security code or codes within both the fob transmitter and receiver. The receiver receives a transmitted signal having a command and a security code and compares the received code with the security code stored in its memory. If the receiver determines the received security code to match the stored code, the command is initiated for execution. For the purposes of the present disclosure, the terms fob key, key code, security code and identification code are used interchangeably and are intended to have the same meaning.

As the demand for RKE systems has evolved in the marketplace, greater emphasis has been placed on increased security, reliability and flexibility. One area of focus has been on enabling the user in the field to re-program the security code(s) stored in receiver memory. This RKE feature, frequently referred to as "field programming," provides the user with an additional form of protection by allowing changes to the security codes.

Field programming is known in the art. A common issue within field programming is how to process old security codes stored in receiver memory upon programming new codes. One solution proposes overwriting all old codes previously added to the receiver's memory when a first new code is presented. In this scheme, a first new code is written into every available register in the receiver's memory. In the event a second fob transmitter is to be employed, a second new code is written into the second memory register and in all remaining subsequent registers. Likewise, any third or subsequent codes are added to the remaining registers in a similar fashion.

In a further approach, a method of field programming is known wherein a first new code is written into a first register in memory, while all other registers are erased. Other codes may be subsequently written into respective registers—i.e., a second new code written into a second register, a third new code written into a third register, and a fourth new code written into a fourth register, for example.

These known methods, however, have several shortcomings. Erasing and overwriting all memory locations at once is a time consuming process. Typically, EEPROMs require the erasure of a memory bit before rewriting. The erase/write cycle time is thus lengthy compared to other software processes. In order to achieve a low latency period in providing a response to the user of a successful programming operation, it is useful to only erase/write the location that the new security code will be stored into memory.

Therefore, there is a demand for a field programming method having a low latency period to provide the user with a response of a successful programming operation. Furthermore, a field programming method is required which is limited to only erasing/writing the location that the new security code will be stored into memory.

SUMMARY OF THE INVENTION

The primary advantage of the present invention is to overcome the limitations of the prior art.

In order to achieve the advantages of the present invention, a remote control system is disclosed. The remote control system comprises a transmitter for transmitting a first data signal in turn comprising a command and an identification code. Further, the remote control system comprises a receiver for receiving the first data signal having an operational mode for initiating the received command if the first received identification code matches a stored authentic and valid identification code, and a programming mode for storing received valid identification codes. The receiver comprises a switch for switching between the operational and programming mode, a memory having locations for storing authentic and valid identification codes, and a processor. If the receiver is in the operational mode, the processor accesses the authentic and valid identification codes from memory, compares the first received identification code with the accessed authentic and valid identification codes, and initiates the received command if the received identification code matches with one of the accessed authentic and valid identification codes. If, however, the receiver is in a first session of the programming mode, the processor tests the validity of the first received identification code, unauthenticates the previously stored authentic and valid identification codes should the first received identification code be valid, and writes the first received, tested and validated identification code into a first location in memory as authentic and valid.

In a further embodiment of the invention, a field programming method is disclosed for remotely programming received identification codes into a receiver having a memory for supplying stored authentic and valid identification codes if the receiver is in an operational mode, and for storing valid identification codes if the receiver is in a field programming mode. The field programming method initially tests the validity of a first received identification code. Subsequently, the stored authentic and valid identification codes are unauthenticated if the first received identification code is valid. Finally, the first received tested and validated identification code is written into a first location in the memory as authentic and valid.

These and other advantages and objects will become apparent to those skilled in the art from the following detailed description read in conjunction with the appended claims and the drawings attached hereto.

BRIEF DESCRIPTION OF THE DRAWINGS

Other objects, features and aspects of the present inventions will be further understood from reading the specification in conjunction with the drawings which are.

It should be emphasized that the drawings of the instant application are not to scale but are merely schematic representations and are not intended to portray the specific parameters or the structural details of the invention, which can be determined by one of skill in the art by examination of the information herein.

DETAILED DESCRIPTION OF THE PREFERRED EMBODIMENT

Figure 1:
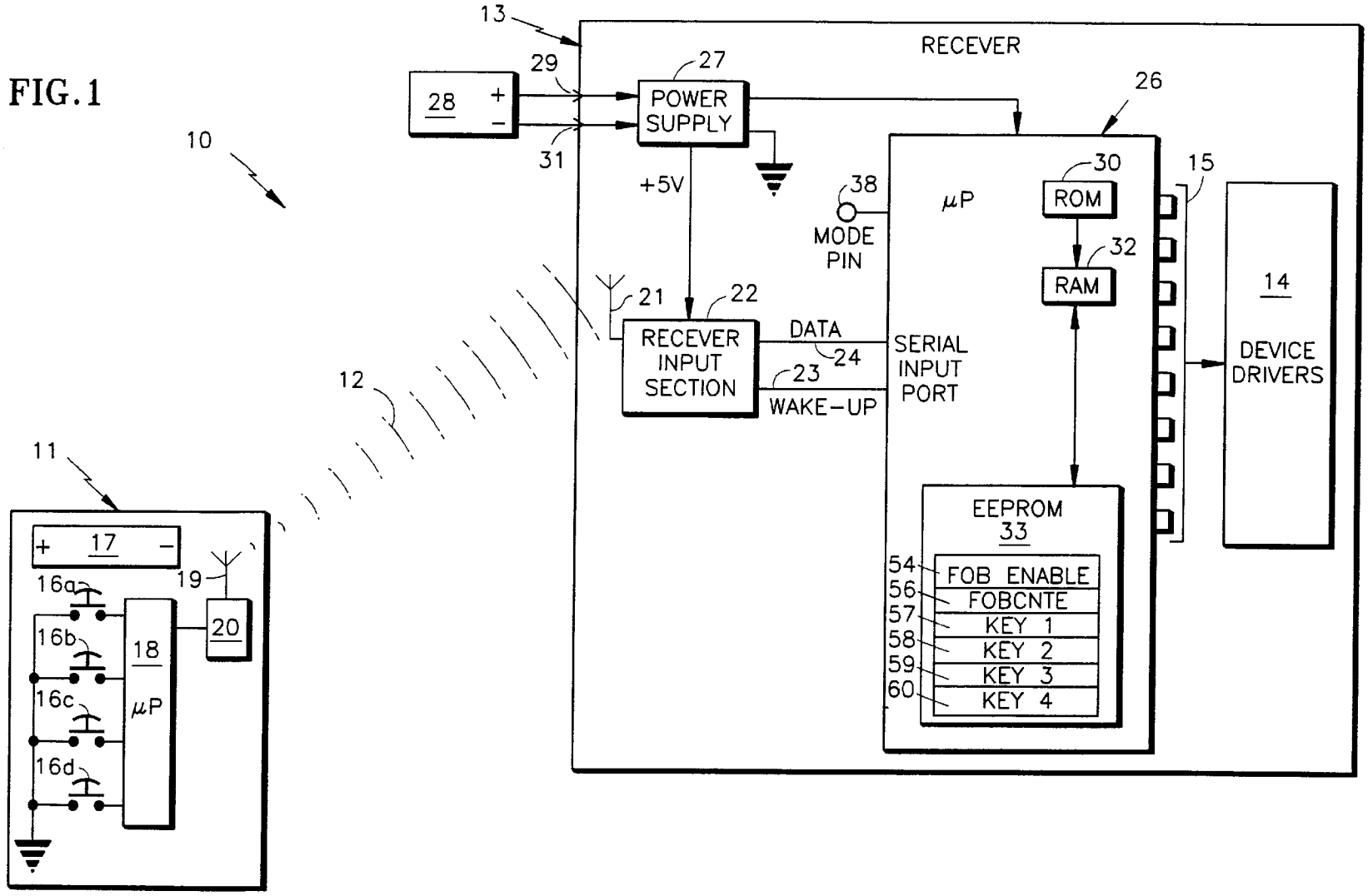
FIG. 1 is a block diagram of a remote keyless entry system according to the preferred embodiment of the present invention.

The Remote Keyless Entry System (FIG. 1)

General

Referring to FIG. 1, is a block diagram of a remote keyless entry system 10 according to the preferred embodiment of the present invention. Remote keyless entry system 10 comprises a transmitter 11 for transmitting a signal 12 to a receiver 13. In the preferred embodiment, system 10, generally, and signal 12 more specifically, comprise a radio frequency ("RF") format. In response to receiving signal 12, receiver 13 enables one of several functions by means of a corresponding output from device drivers 14. In the preferred embodiment of the present invention, receiver 13 is mounted in a vehicle (not shown), such as an automobile, truck, sports utility vehicle or van, for example.

Receiver 13 comprises a programmed processor 26 for interpreting signal 12 and for generating actuating signals. Processor 26 sends the actuating signals to selected device drivers 14 via one or more of the processor's output ports 15. Individual output ports are coupled to specific device drivers to facilitate the reception of the actuation signals.

In further embodiment of the present invention, some or all of the output ports 15 of the preferred embodiment are replaced by a multiplexed data bus (not shown) for coupling processor 26 with an external processor (not shown). Alternately, however, a serial or parallel design may be substituted for the multiplexed data bus. Processor 26 transmits actuations signals through the bus to the external processor to which the device drivers 14 are coupled. The external processor thereafter sends actuation commands directly to the intended device driver.

Device drivers 14 may be realized by various components including processors, state machines, controllers, logic circuits, motors, solenoids, switches and other electrical and/or electromechanical devices. System 10, through device drivers 14, may perform remote system functions, such as locking or unlocking a vehicle door, trunk lid, hood or the like, arming or disarming a security system, electrically and or mechanically disabling the operation of the vehicle, turning the head lights and/or interior lights on or off, and raising or lowering side and/or rear windows.

In the preferred embodiment, transmitter 11 is an RF device realized within a fob, and includes four enable/disable switches 16*a*, 16*b*, 16*c* and 16*d*, preferably of the push button variety. Each switch, 16*a*, 16*b*, 16*c* and 16*d*, enables a particular system function. For example, switch 16*a* is enabled to unlock the driver side door or all doors on a vehicle, while switch 16*b* locks all doors. Likewise, switch 16*c*, for example, is enabled to lock or unlock a trunk lid on an automobile or a sliding side door on a van, while switch 16*d* is enabled to set off a theft deterrent alarm which might include the flashing of the vehicles lights and the rapid, loud beeping of the vehicle's horn.

Fob 11 comprises a power source 17 for powering the transmitter. In the preferred embodiment, power source 17 comprises one or two three volt (3 V) batteries. In an alternate embodiment, power source 17 comprises a regulated 5 volt source.

Fob 11, moreover, comprises a processor 18 for performing various system functions. This includes permanently storing fob information in the form of a multiplicity of binary bits representing any one of a plurality of command codes to which one or more desired vehicle system functions are executed by receiver 13. Fob information also includes a security code or key code portion which is tested by receiver 13 for authenticity before executing a vehicle function in response to a command. Thus, fob information comprises both command codes for executing particular vehicle system functions and a security code for distinctly identifying fob transmitter 11 to receiver 13.

Each push button switch, 16*a* through 16*d*, on fob 11 is associated with at least one unique command code. Upon enabling one push button switch, several steps are performed by processor 18 to execute an intended system function through receiver 13. This includes the transmission of fob information by fob transmitter 11 to receiver 13 to actuate a system function. Receiver 13, prior to executing the command, first authenticates the transmitted security code from the transmitted fob information for security purposes.

In an alternate embodiment, the key code portion of the fob information transmitted is further subdivided into a "secret" code portion and a "plain" code. Here, the command and the secret key portions are encrypted using one of various known encryption techniques. By this design, the plain code portion of the key code is not encrypted. Having fewer bits and being otherwise easier to interpret than the secret encrypted code, the plain code portion is used to locate matching secret and plain code among several memory registers within the receiver.

In a preferred embodiment of the present invention, the maximum number of fobs independently able to remotely access the system functions with any one vehicle having a corresponding receiver installed is four (4). This number is preferably limited to four because a larger number meaningfully increases the probability of damage, misplacement and theft of at least one fob. Another consideration is that in the event one fob is a damaged, stolen or lost, the receiver can be reprogrammed with a new set of fobs as replacements.

In addition to comprising processor 18, fob transmitter 11 also comprises an antenna 19 coupled thereto. Fob transmitter 11 is preferably coupled with receiver 13 by means of RF oscillator 20 and antenna 19. In a first alternative, transmitter 11 communicates with receiver 13 through an optical link such that oscillator 20 and antenna 19 are replaced by a light emitting diode ("LED"). Other alternatives include an acoustic interface between the transmitter and receiver, as well as a hardwired realization.

Fob processor 18 applies specific formatted fob information to oscillator 20 and antenna 19 in response to one of push-buttons, 16*a* though 16*d*, being enabled. The signal emitted by antenna 19 also comprises a wake up burst signal, preferably an unmodulated RF carrier, followed by a modulated signal comprising the fob information. The leading portion of the wake up burst signal is detected by an antenna 21 of receiver 13, and is transmitted to a receiver input section 22 and, as a result, to an input port 23 of processor 26. To conserve energy, processor 26 is powered OFF or is in a low power state while waiting to receive an RF signal from a fob.

As a result of receiver 13 receiving the wake up burst signal, processor 26 is awoken and prepared for processing the fob information being received by receiver 13. The modulated carrier containing the fob information received by receiver 13 is converted to fob information by a demodulator within input section 22. The fob converted information is routed into processor 26 via serial input port 24 where it is temporarily stored in a message buffer (not shown). Once the converted fob information is stored in the message buffer it is referred to as the received fob information or the received message.

Processor 26 has on-chip memory 32. On-chip memory 32 is realized by volatile RAM used for processing fob information during the program and operational modes. Moreover, on-chip memory 32 comprises non-volatile ROM memory 30 for storing the program software for processor 26. Memory 30 may be realized by PROM or EEPROM, though ROM is the preferred choice. On chip memory further comprises non-volatile EEPROM memory 33. Non-volatile EEPROM memory 33 comprises the key registers 57–60 for storing fob key information. Memory 33 may be realized by other means though an EEPROM is preferable. Memory 33 may be contained within processor 26 as detailed herein. In an alternative embodiment, a serial or parallel addressed external EEPROM memory device is used.

Receiver 13 is powered by a battery 28. According to the preferred embodiment, battery 28 is a 12 volt automobile battery which is electrically coupled at (+) and (−) terminals to inputs 29 and 31 of receiver 13. Inputs 29 and 31 preferably feed a 5 Volt power supply 27 to produce a regulated 5 Volt output for the operation of processor 26 and input section 22.

Receiver 13 has essentially two modes of operation, program mode or an operational mode, in which it operates to process fob information through processor 26. During the program mode, fob security code information may be programmed into one or more key registers within EEPROM 33 of processor 26. During operational mode, receiver 13 enables authorized holders of fobs 11 associated with a given vehicle to transmit signal 12 to receiver 13 to remotely perform a system function, such as lock/unlock doors, for example. In recent vehicle model years, vehicles which are factory equipped with a receiver 13 have fob information from one or more fobs 11 programmed into EEPROM 33 by employees of an automobile dealership who prepare the vehicle for delivery to the owner.

Processor 26 is placed in program mode by grounding or placing a signal on a mode control pin 38 on processor 26, as shown in FIG. 1. Processor 22 is also switched into the operational mode, as detailed in FIG. 2, by removing the ground or signal from pin 38. In a further embodiment of the present invention, processor 26 is switched between the program and operational modes by a message received by processor 26 over a vehicle data bus from a second vehicle processor located externally to receiver 13.

The System Modes

Figure 2:
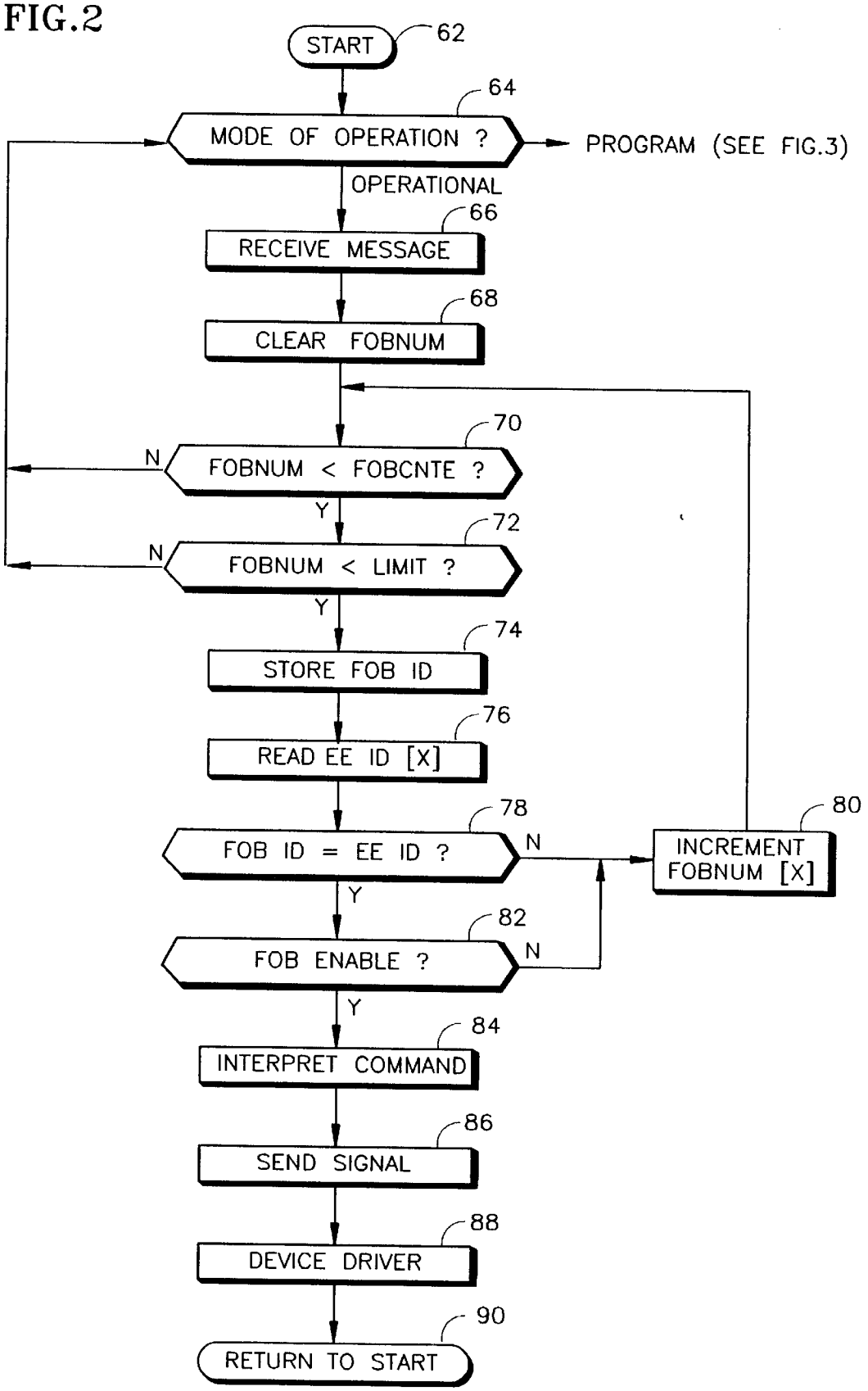
FIG. 2 is a flow chart of the system illustrated in FIG. 1 representing functions performed during a first mode of the operation.

Referring to FIG. 2, a flow chart of system 10 representing functions performed during an operational mode is illustrated. During the operational mode of system 10, processor 26 is designed to compare the security code portion of a newly received message with the security code information stored in each of the EEPROM key registers, 57 through 60 of FIG. 1. Thereafter, once a match is made between the received and stored security code information, processor 26 reads the function command in the received message. In due course, processor 26 sends a signal, SEND SIGNAL 86, from an actuation means to a specific device driver 14, DEVICE DRIVER 88, to enable a system function, such as, for example, to unlock an automobile's driver side door.

Processor 26 also prevents fob information which fails to favorably compare with one of the group of four key registers 57–60 of FIG. 1 from actuating a device driver. Likewise, processor 26 precludes security codes stored in key registers 59 and 60, the third and fourth of the four eligible registers in the preferred embodiment, which were programmed during a first program mode to remain valid after exiting a second program mode in which new security codes are programmed only into key registers 57 and 58.

The foregoing performance is preferably realized by means of an enable register 54 and a fob counter, represented by the FOBCNTE register 56, both illustrated within the EEPROM 33 of FIG. 1.

The Fob Counter

During a programming mode session, FOBCNTE register 56 functionally counts the number of security codes entered into one or more key registers in EEPROM 33. If only a singular security code is entered into register 57 during the programing mode, FOBCNTE register 56 counts and stores a value of one. Similarly, FOBCNTE register 56 counts and stores values of 2, 3 or 4, when two, three or four security codes are respectively entered into key registers 57 through 60 during a programing mode session. While the preferred embodiment employs four registers 57 though 60, it should be understood that the number of available key registers may be designed to incorporate a larger or smaller number as required for given applications.

During the programming mode, after each new fob is sequentially stored into key registers 57 through 60, the fob counter associated with FOBCNTE register 56 is incremented. This, however, assumes that four key registers are required by a particular vehicle owner. Consequently, when new security codes are only stored into the first and second registers 57 and 58 during the programming mode, the codes in third and fourth registers 59 and 60 are not accessible in the operational mode because FOBCNTE register 56 is set to two ("2"). In such circumstances, FOBCNTE register 56 permits access to registers at addresses within registers 57 and 58, while excluding access to the registers 59 and 60 because their inclusion exceeds the total count number set within FOBCNTE register 56.

Figure 3:
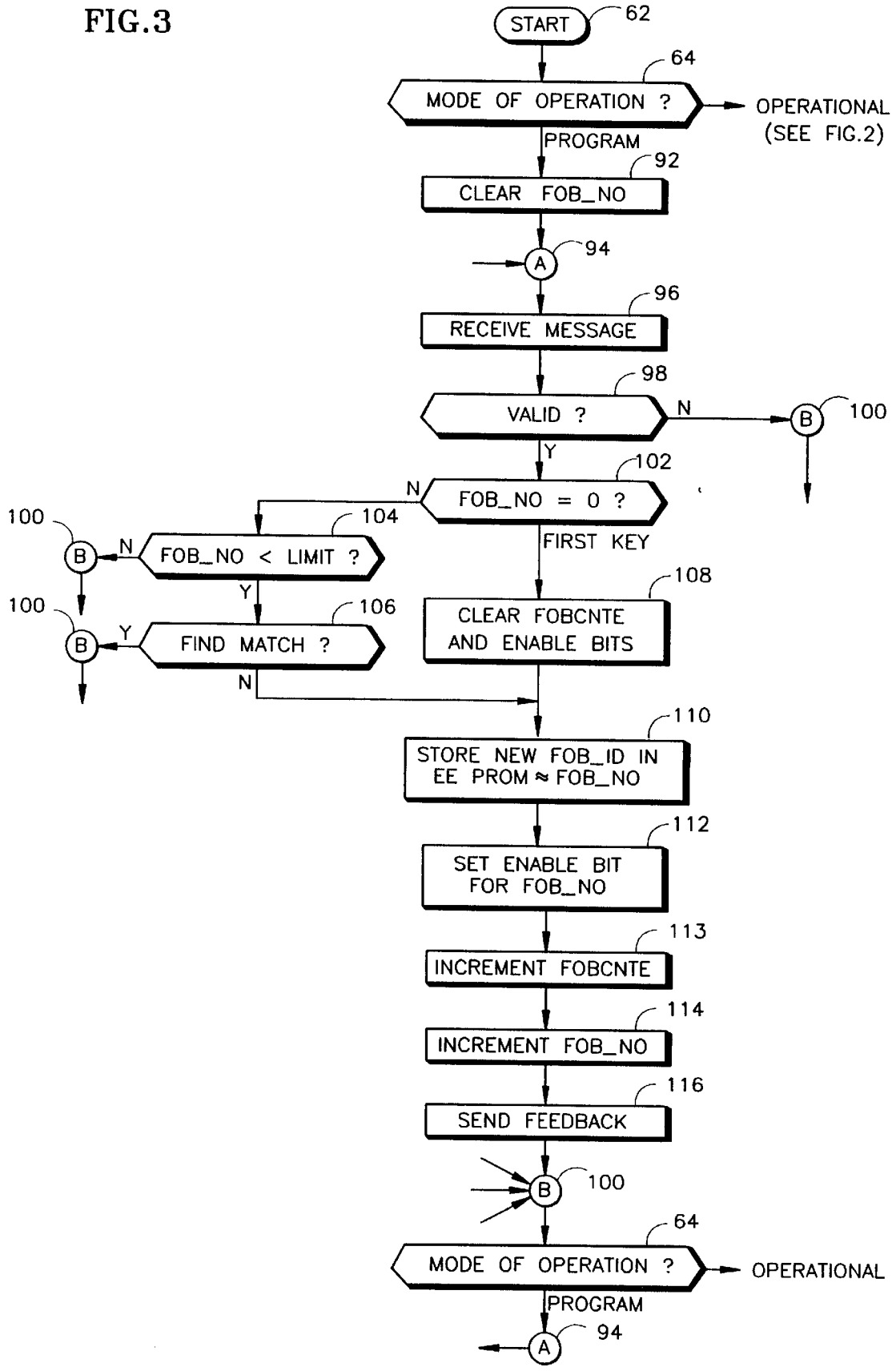
FIG. 3 is a flow chart of the system illustrated in FIG. 1 representing functions performed during the preferred mode of the operation.

FOB_NO is a variable in the programming flow chart of FIG. 3. FOB_NO points respectively to certain registers within the EEPROM corresponding to key registers "0" through "3". In other words, FOB_NO points respectively to certain registers within the EEPROM corresponding to first, second, third and fourth registers, 57 through 60.

Processor 26 also employs a variable FOBNUM appearing in FIG. 2. FOBNUM points to registers "0" through "3" or registers 57 through 60 during an operation loop. Here, the received fob security code is compared during a series of loops with each successive key register. The number of loops, and thus the actual comparison between the received fob security code and successive key registers directly corresponds with the total count number set within FOBCNTE register 56. As such, if FOBCNTE register 56 is set to three, the received fob security code is compared during a first loop with the fob security code in key register 57, compared with the fob security code in key register 58 during a second loop, and then compared with the security code in key register 59 during a third loop. Likewise, if FOBCNTE register 56 is set to four, a fourth loop would be added to enable the received fob security code to be compared with each key register, 57 through 60.

The Enable Register

Referring to FIG. 1, enable register 54 is illustrated. Enable register 54 comprises a single multi-bit register, wherein each bit is associated with one of the key registers 57 through 60. It should be noted, that in an alternative embodiment, enable register 54 comprises several singular bit registers such that each bit is associated with one of the key registers 57 through 60. When set to a given enable value, for example, a binary "1", the enable bit indicates that the associated key register is valid. When the enable bit is set to a binary "0", the resident security code stored within such an invalid key register cannot be read during either the operational or programming modes.

The Operational Mode of Receiver

The default mode of processor 26 is the operational or normal mode. The mode of processor 26 may be changed to programming mode by grounding pin 38 to switch the processor into the programming mode. Under such circumstances, receiver 13 initially waits for the receipt of a new message, or received fob information, to be positioned into a buffer within RAM 32. This buffer is represented by RECEIVE MESSAGE 66 and 96 depicted respectively in the flow charts of FIGS. 2 and 3. Operationally, a value is afforded to a mode flag in MODE OF OPERATION decision means 64.. This mode flag value causes the processor to enter either the operational or programming modes. The mode flag is periodically checked during either modes to respond to a request to a change in mode.

Once a message has been received by RECEIVE MESSAGE 66, the variable FOBNUM is cleared by way of CLEAR FOBNUM 68. Thereafter, processor 26 enters a program loop at comparator (FOBNUM<FBCNTE?) 70 to search for a match between a received message security code and a security code stored in one of the validated registers pointed to by the value of the variable FOBNUM. For the purposes of simplicity, hereinafter, the validated registers refers the four registers, 57 through 60.

Comparator 70 functionally compares the value of pointer FOBNUM with the value of FOBCNTE. By doing so, comparator 70 insures that a match is not being sought for the security code of the received message with the security code in a key register having an address outside the range of eligible registers established by FOBCNTE. As the value of FOBNUM is "0" while testing key register 57 with the value of FOBCNTE being "4", comparator 70 finds that the FOBNUM is less than FOBCNTE and moves the process along to a second comparator (FOBNUM<LIMIT?) 72.

Second comparator 72 compares the value of FOBNUM, the pointer value for register 57, with the value "4" representing the largest permissible number of key registers permitted to be used in the preferred embodiment. During the first pass through the search loop, the second comparator 72 allows the process to go forward to STORE FOB ID 74. STORE FOB ID 74 reads the security code FOB ID, or identification code, portion of the received fob security code into temporary storage to have the FOB ID available to third comparator (FOB ID=EE ID?) 78 for comparing the FOB ID with the EE ID security code. This EE ID security code is a valid security code stored in EEPROM.

Comparator 78 compares FOB ID with EE ID. In the event that FOB ID and EE ID do not match, the FOBNUM is incremented from a count of "0" to a count of "1" by INCREMENT FOBNUM[X] means 80. Thus, the first cycle of loop is completed. Subsequently, the loop enters its second cycle to exercise the same comparing function of FOB ID with the contents of the next key register at address "1" which is register 58. The incrementing of FOBNUM by INCREMENT FOBNUM[X] means 80 is repeated in a like fashion until a security code of a register EE ID matches the security code portion FOB ID of the received message.

Ultimately, in the event no match is realized between the received FOB ID and the EE ID of each security code stored within those eligible key registers 57 through 60, comparator 70 will take the program out of the search loop. More specifically, after the final loop, the value of FOBNUM is incremented to a value equal to the value of FOBCNTE which contains the number of key registers programmed during the most recent programming mode session.

On the other hand, if, however, a match is made between FOB ID and EE ID during one of the loops, the enable bit in the FOB ENABLE 54 register associated with the "matching" key register is checked at FOB ENABLE verify means 82. FOB ENABLE verify means 82 reads the enable bit associated with the matching key register and, if the enable is set to the value "0", the process is sent back to INCREMENT FOBNUM[X] 80 to increment FOBNUM. Additionally, the system re-enters the search loop until either a match with a valid key register is found or the loop process is completed by comparator, 70 or 72. In the later case, once the value of FOBNUM equals the value of FOBCNTE or reaches the limit of "4", comparators, 70 or 72, causes the loop to be completed.

In the event FOB ENABLE verify means 82 reads the enable bit associated with the matching key register as set to the value "1", the received message is valid. The INTERPRET COMMAND means 84 then reads the command portion of the now validated received message. Subsequently, an actuation signal corresponding to the particular command is transmitted by SEND SIGNAL 86 to the intended device driver 14 thereby resulting in actuation of the intended vehicle system function by the device driver. Thereafter, subsequent messages received while the system is in the operational mode are processed in the same manner until the processor 26 is switched to the programming mode.

The Programming Mode of Receiver

As with the operational mode, the programming mode waits for the receipt of a new message, or received fob information, within a buffer in RAM 32. The buffer is represented by RECEIVED MESSAGE 66 and 96, respectively illustrated in FIGS. 2 and 3. Functionally, MODE OF OPERATION means 64 continuously checks the mode of processor 26. This is achieved by having the system periodically check the value of a mode flag. Switching between modes may be achieved by various means. In one embodiment, the grounding of mode control pin 38 on processor 26 causes a switch between modes. In a further embodiment of the present invention, the switch between modes is caused by a message received over a vehicle data bus.

Upon entering the programming mode, CLEAR FOB_NO means 92 immediately sets FOB_NO to the value "0". By doing so, CLEAR FOB-NO means 92 insures that the programming of the key registers 57 through 60 begins with register 57, the "0" address key register. The new fob key or security code information is then obtained by the RECEIVE MESSAGE means 96. Thereafter, the validity of the new key is tested by means of the VALID decision block 98. The validity test may be accomplished by one or more of the following methods. The key fob message's bit timing and length must equal that expected from a transmitter for the system in use. A checksum or error correction code may be included as part of the message, and must match the rest of the received message. In the alternative, the system may simply require that the same message must be received two or more times in a row. If the message is not valid, however, the system returns to checking the processor mode and waiting for another message or a change in the system's mode of operation.

In the event the message tests as valid, comparator (FOB_NO=0?) 102 checks the value of pointer FOB_NO to determine if the received message is the first received by the system. If FOB_NO is equal to "0", then the message is the first received, and comparator (FOB_NO=0?) 102 routes the message along the process path to CLEAR FOBCNTE & ENABLE BITS means 108. However, if pointer FOB_NO is set to a value greater than "0", then the message is not the first received, and comparator (FOB_NO=0?) 102 routes the second and all subsequently received messages, if any, along the process path to comparator (FOB_NO<LIMIT?) means 104.

In the event FOB NO is equal to "0" a first message is indicated, and CLEAR FOBCNTE & ENABLE BITS means 108 sets FOBCNTE register 56 in EEPROM 33, and all the enable bits of enable bit register 54 in EEPROM 33 to the value "0". By clearing the enable register 54, all four key registers, 57 through 60, are invalidated, all while the contents of the key registers remain intact. Independently, the clearing of FOBCNTE to a zero value also prevents any of the key registers in EEPROM 33 from being used as valid key registers in the operation mode. Therefore, the programmed processor is initialized for programming or storing new fob security codes into the four key registers within the EEPROM.

The first received fob security code is stored into key register 57 by STORE NEW FOB ID means 110 following the clearing step performed by CLEAR FOBCNTE & ENABLE BITS means 108. As FOB_NO is set to "0", it points to the first or "0" key register 57. Key register 57 is transformed into a "valid" key register by SET ENABLE BIT FOR FOB_NO means 112 and INCREMENT FOBCNTE means 113. SET ENABLE BIT FOR FOB_NO means 112 completes the first of two steps to validate key register 57 by writing the value "1" into the enable bit position within enable register 54 associated with the key register 57, the "0" address key register. INCREMENT FOBCNTE means 113 completes the validation process by incrementing FOBCNTE to the value "1" to permit register 57 (address "0") to be recognized as a valid key register during both the program and operational modes. FOB_NO is then incremented from a count of "0" to a count of "1" by INCREMENT FOB_NO means 114. Thus, the system is now set to recognize a second valid transmission and to load that into the second key register 58 in EEPROM 33. Finally, SEND FEEDBACK means 116 sends an actuation signal to device driver 14, to command, for example, cycling the driver's side door lock once. By doing so, a signal is sent to the programmer to signal that fob 11 has been successfully programmed to operate the vehicle in which the receiver is mounted.

System 10 of FIG. 1 comprises several alternate embodiments. In a first alternative only enable register 54 is used to validate key registers. In the second alternative, however, only a fob counter associated with FOBCNTE is used to validate key registers.

Attention is now directed to the process steps followed when a second message to be programmed is received in the message buffer represented by RECEIVED MESSAGE 96. As noted above, comparator (FOB_NO=0?) 102 routes the second and any other new messages for processing along the path beginning with comparator (FOB_NO<LIMIT?) means 104. Comparator 104 is functionally similar to comparator (FOBNUM<LIMIT?) means 72 of FIG. 2. Comparator (FOB_NO<LIMIT?) means 104 compares FOB_NO with the limit number, or the maximum number of fobs permitted to be programmed by the system. As detailed hereinabove, this limit number is preferably set to a value of "4". FOB_NO assumes the values "0", "1", "2" and "3", respectively, during the processing of the first, second, third and fourth messages received during the current programming mode session. INCREMENT FOB_NO means 114 increases the count value of FOB_NO from a value of "0" to a value of "1" after the storage of the first key into key register 57. Likewise, FOB_NO is continuously incremented following the storage of additional new fob keys into registers 58 through 60. The comparison made by comparator (FOB_NO<LIMIT?) means 104 during the processing of the second through fourth messages is subsequently passed from comparator 104 to comparator (FIND MATCH?) means 106 when the value of FOB_NO for those received messages is less than "4". Thus, a fifth message causes comparator (FOB_NO<LIMIT?) means 104 to route the processor back to point "B" 100, as shown in FIG. 3. Point "B" 100 passes the process into MODE OF OPERATION means 64 to check the processor mode of operation and await another message or mode change.

Comparator (FIND MATCH?) means 106 avoids programming the same message into more than one key register by comparing the fob key information in a newly received message with that stored in previous key registers. If a match is made, comparator (FIND MATCH?) means 106 returns the process to point "B" 100, thereby passing the process into MODE OF OPERATION means 64 to check the processor mode of operation and await another message or mode change. If no matches are made, the processing of the second, third and fourth new messages proceeds along the steps represented by the functional means (STORE, SET ENABLE, INCREMENT FOBCNTE, INCREMENT FOB_NO and SEND FEEDBACK) 110 through 116 detailed herein in connection with the programming of the first message into key register 57.

While the particular invention has been described with reference to illustrative embodiments, this description is not meant to be construed in a limiting sense. It is understood that although the present invention has been described in a preferred embodiment, various modifications of the illustrative embodiments, as well as additional embodiments of the invention, will be apparent to persons skilled in the art upon reference to this description without departing from the spirit of the invention, as recited in the claims appended hereto. Thus, for example, it should be apparent to one of ordinary skill in the art that while the present invention is applicable to vehicular remote keyless entry systems, it is also suitable in conjunction with other control systems having a programming mode for programming codes into memory, such as computer and telephone systems, garage door openers, traditional building entrances, limited access areas and buildings, safes, jail cells, and the like. Similarly, it should be apparent to one ordinary skill in the art while the remote control system of the present invention has been detailed as operating in the RF frequency range, other formats including microwave, light, for example, are available which would take full advantage of the present invention. Moreover, while the present details a receiver comprising a programmed processor, it should also be apparent to one of ordinary skill in the art that the receiver in the alternative may be realized by means of a state machine on an application specific integrated circuit ("ASIC"). It is therefore contemplated that the appended claims will cover any such modifications or embodiments as fall within the true scope of the invention.

All of the U.S. Patents cited herein are hereby incorporated by reference as if set forth in their entirety.

What is claimed is:

1. A remote control system comprising:

a transmitter for transmitting a first data signal, said first data signal comprising:
a command; and
an identification code; and a receiver for receiving said first data signal, said receiver having an operational mode for initiating said received command if said first received identification code matches a stored authentic and valid identification code, and a programming mode for storing received valid identification codes, said receiver comprising:
a switch for switching between said operational mode and said programming mode;
a memory having multiple locations for storing authentic and valid identification codes; and
a processor,
if said receiver is in said operational mode,
for accessing said authentic and valid identification codes from said memory;
for comparing said first received identification code with said accessed authentic and valid identification codes; and
for initiating said received command if said received identification code matches with one of said accessed authentic and valid identification codes; and
if said receiver is in a first session of said programming mode,
for testing the validity of said first received identification code;
for unauthenticating without deleting or overwriting said stored authentic and valid identification codes if said first received identification code is valid; and
for writing said first received, tested and validated identification code entry into a single first location in said memory as authentic and valid.

2. The invention of claim 1, wherein said receiver receives a second data signal while in said first session of said programming mode, and said processor tests the validity of said second received identification code, unauthenticates said stored authentic and valid identification codes entered during another session of said programming mode if said second received identification code is valid, and writes said second received, tested and validated identification code into a second location in said memory as authentic and valid.

3. The invention of claim 2, wherein said first and second received, tested and validated identification codes are written into said first and second locations of said memory, respectively, as authentic and valid at the conclusion of said first session of said programming mode.

4. The invention of claim 1, wherein said processor comprises a marking device for marking said stored authentic and valid identification codes in said memory as unauthentic if said first received identification code is valid and said receiver is in said programming mode.

5. The invention of claim 4, wherein said marking device comprises a bit register for storing a bit for each of said accessed identification codes in said memory reflective of the authentic status of each accessed identification code.

6. The invention of claim 4, wherein said marking device comprises a counter for counting the number of authentic and valid identification codes in said memory.

7. The invention of claim 6, wherein said marking device further comprises a pointer for pointing to a location in said memory where a received, tested and validated identification code is to be written in said memory, said pointer being incremented after each newly received, tested and validated identification code is written in said memory during a single session of said programming mode.

8. The invention of claim 7, wherein said pointer is incremented with said counter after each newly received, tested and validated identification code is written in said memory during a single session of said programming mode.

9. A remote control system comprising:

a first transmitter for transmitting a first data signal, said first data signal comprising:
a command; and
an identification code; and a receiver for receiving said first data signal, said receiver having an operational mode for enabling said received command if said first received identification code matches a stored authentic and valid identification code, and a programming mode for storing received valid identification codes, said receiver comprising:
a switch for switching between said operational mode and said programming mode;
a memory having multiple locations for supplying stored authentic and valid identification codes if said receiver is in said operational mode, and for storing valid identification codes if said receiver is in said programming mode;
a processor,
if said receiver is in said operational mode,
for accessing said authentic and valid identification codes from said memory;
for comparing said first received identification code with said accessed authentic and valid identification codes; and
for initiating said received command if said received identification code matches with one of said accessed authentic and valid identification codes; and
if said receiver is in a first session of said programming mode,
for testing the validity of said first received identification code;
for unauthenticating without deleting or overwriting said stored authentic and valid identification codes if said first received identification code is valid; and
for writing said first received, tested and validated identification code only into a single first location in said memory as authentic and valid,
said processor comprising a marking device for marking said stored authentic and valid identification codes in said memory as unauthentic if said first received identification code is valid and said receiver is in said first session of said programming mode, said marking device comprising:
a bit register for storing a bit for each of said accessed authentic and valid identification codes in said memory reflective of the authentic status of each authentic and valid identification code; and a counter for counting the number of authentic and valid identification codes in said memory.

10. The invention of claim 9, wherein said receiver receives a second data signal while in said first session of said programming mode, and said processor tests the validity of said second received identification code, unauthenticates said stored authentic and valid identification codes entered during another session of said programming mode if said second received identification code is valid, and writes said second received, tested and validated identification code into a second location in said memory as authentic and valid.

11. The invention of claim 10, wherein said first and second received, tested and validated identification codes are written into said first and second locations of said memory, respectively, as authentic and valid at the conclusion of said first session of said programming mode.

12. The invention of claim 10, wherein said marking device further comprises a pointer for pointing to a location in said memory where a received, tested and validated identification code is to be written in said memory, said pointer being incremented after each newly received, tested and validated identification code is written in said memory during a single session of said programming mode.

13. The invention of claim 12, wherein said pointer is incremented with said counter after each newly received, tested and validated identification code is written in said memory during a single session of said programming mode.

14. A field programming method for remotely programming received identification codes into a receiver, the receiver having a memory having multiple locations for supplying stored authentic and valid identification codes if the receiver is in an operational mode, and for storing valid identification codes if the receiver is in a field programming mode, the field programming method comprising the steps of:

testing the validity of a first received identification code;

unauthenticating without deleting or overwriting the stored authentic and valid identification codes if said first received identification code is valid; and writing said first received, tested and validated identification code only into a single first location in the memory as authentic and valid.

15. The method of claim 14, further comprising the steps:

accessing the authentic and valid identification codes from the memory;

comparing said first received identification code with said accessed authentic and valid identification codes; and initiating a command if said received identification code matches one of said accessed authentic and valid identification codes, if the receiver is in the operational mode.

16. The method of claim 14, further comprising the steps of:

receiving a second identification code;

testing the validity of said second received identification code;

unauthenticating said stored authentic and valid identification codes entered during another session of the field programming mode if said second received identification code is valid; and writing the second received, tested and validated identification code into a second location in said memory as authentic and valid.

17. The method of claim 16, further comprising the steps of:

writing said first and second received, tested and validated identification codes into said first and second locations of said memory, respectively, as authentic and valid at the conclusion of the field programming mode.

18. The method of claim 14, further comprising the step of:

marking said stored authentic and valid identification codes in the memory as unauthentic if said first received identification code is valid.

19. The method of claim 18, further comprising the step of:

storing a bit for each of said accessed identification codes in the memory reflective of the authentic status of each accessed identification code.

20. The method of claim 18, further comprising the step of:

counting the number of authentic and valid identification codes in said memory.

21. The method of claim 20, further comprising the step of:

pointing to a location in the memory where a received, tested and validated identification code is to be written in said memory; and incrementing said step of pointing after each newly received, tested and validated identification code is written in the memory.

22. The method of claim 21, wherein said step of incrementing if performed after each newly received, tested and validated identification code is written in the memory.

* * * * *